US005564354A

United States Patent [19]

Wang et al.

[11] Patent Number: 5,564,354

[45] Date of Patent: Oct. 15, 1996

[54] NEEDLE-CHANGING MECHANISM FOR MULTIPLE-NEEDLE EMBROIDERY SEWING MACHINE

[75] Inventors: Yu-Sheng Wang; Han-Chieh Chang; Hung-I Hsu; Wen-Chin Cheng; Jin-Lunng Chirn, all of Hsinchu, Taiwan

[73] Assignee: Industrial Technology Research Institute, Hsinchu Hsier, Taiwan

[21] Appl. No.: 355,733

[22] Filed: Dec. 14, 1994

[51] Int. Cl.[6] ..... D05C 11/06

[52] U.S. Cl. ..... 112/98; 112/163; 112/470.04

[58] Field of Search ..... 112/163, 167, 112/102.5, 78, 98, 80.43, 470.12, 470.04, 475.18, 475.19, 275

[56] References Cited

U.S. PATENT DOCUMENTS

| | | | |
|---|---|---|---|
| 4,754,721 | 7/1988 | Skogward | 112/275 |
| 5,390,613 | 2/1995 | Shibata | 112/163 |

*Primary Examiner*—Peter Nerbun
*Attorney, Agent, or Firm*—W. Wayne Liauh

[57] ABSTRACT

A needle-changing mechanism for use in a multiple-needle embroidery sewing machine is disclosed for controlling the changing of a selected sewing needle to a working position on the sewing platform of the sewing machine. The needle-changing mechanism includes a sensing plate having a gap portion sandwiched between two solid side portions. The position of the gap portion is changed by moving the sensing plate according to which needle is currently selected as the working needle. A plurality of photo detectors equal in number to the number of the needles of the sewing machine are arranged at equal intervals along a straight line relative to the axial orientation of the sensing plate such that the gap portion and the side portions of the sensing plate cause the photo detectors to output a pattern of positioning signals. A controller, which receives and processes output signals from the photo detectors, is used to control the movement of the needles so that the desired needle is positioned as the working needle. Among the advantages of the present invention are that it requires only a single positioning signal for the changing and positioning of the needles; it is capable of restoring the position of the current working needle after a power failure that causes the working needle to be out of position; and it can be constructed without the use of gears so as to reduce cost and facilitate easy assemblage.

11 Claims, 7 Drawing Sheets

NEEDLE-CHANGING MECHANISM FOR MULTIPLE-NEEDLE EMBROIDERY SEWING MACHINE

BACKGROUND OF THE INVENTION

1. Field of the Invention

The present invention relates to sewing machines, and more particularly to a needle-changing mechanism for use in multiple-needle embroidery sewing machines.

2. Description of Prior Art

The sewing of embroidery on fabrics is often carried out using multiple needles. Each of these needles bears a thread of a different color such that the embroidery can be made with various colors. In the operation of sewing machines, applying a different color to the embroidery requires simply the changing of the current working needle to another one that bears the thread of the desired color.

FIG. 1 shows one prior art needle-changing mechanism for use in embroidery sewing machines, which was developed by TAJIMA Company of Japan. The needle-changing mechanism includes a sewing head 11, a set of sewing needles 12, a transmission bar 13, a sliding block 14, a sliding column 15, a motor 16, gear sets 17, 17', a spiral shaft 18, a circuit board 19, a large disk 110, a small disk 111, a photo detector 112, an output signal line 113 coupled to the large disk, and an output signal line 114 coupled to the small disk. The sliding column 15 can be driven to move by the spiral shaft 18. When the motor 16 rotates, it drives the spiral shaft 18 via the gear set 17, thereby moving the sliding block to slide horizontally to the left or to the right, which in turn moves the sewing needle 12 on the sewing head 11 to move accordingly to change the working needle to another.

When the spiral shaft 18 rotates, it in turn drives the large disk 110 and the small disk 111 via the gear set 17'. A number of proximity detectors equal to the number of sewing needles are provided on the large disk 110. During a needle-changing process, when the desired needle, say needle #1, is about to reach the working position, a proximity detector on the large disk, say the proximity detector #1, reaches Position A, thereby generating a first positioning signal. On the small disk 111, there are two gap portions, which are operatively related to the photo detectors 112. When the desired needle #1 reaches the working position, one gap portion lies within the space between the two side walls of the photo detector 112, thereby allowing the light beam to pass therethrough, which generates the second positioning signal. The action of the whole needle-changing process is based on these two positioning signals.

It is a drawback of the foregoing prior art that two positioning signals have to be used for the needle-changing action. Moreover, the prior art devices lack the capability to restore the position of current working needle after a power failure which would cause the working needle to be out of position. Furthermore, since gear sets 17 and 17' are used, the cost and complexity in assemblage are greatly increased.

FIG. 2 shows another prior art needle-changing mechanism, which was developed by HAPPY Company of Japan. This prior art uses a plurality of photo detectors in cooperation with a disk without gap portions. The structure includes a sewing head 21, a set of sewing needles 22, a transmission bar 23, a screw 24, sliding columns **25*a*–25*c*, a motor 26, a gear set 27, a spiral shaft 28, a circuit board 29, an array of photo detectors 210, a small disk 211, a photo detector 212, an output signal line 213 coupled to the photo detectors, an output signal line 214 coupled to the small disk 211, and a sensing plate 215. The array of photo detectors 210*a*–210*e* are arranged along a straight line on the circuit board and the photo detector 212 is arranged in another position. The sensing plate 215 is not provided with any gap portions and is fixed to the transmission bar 23 by means of the screw 24. In operation, the sensing plate moves through the gaps of the photo detectors 210*a*–210*e*. The sliding column 25*a* is inserted in the grooves of the spiral shaft 28 and the sliding column 25*b*–25*c* are directed into the grooves one after the other when the spiral shaft 28** moves.

When the motor 26 rotates, the spiral shaft 28 is driven to move the transmission bar 23 horizontally to the left or to the right, thereby carrying out the needle-changing process. Taking the drawing of FIG. 2 as an example, when the sensing plate 215 blocks the light beam in the photo detector **210*c* and not in the photo detectors 210*b* and 210*d*, a signal pattern (210*a*, 210*b*, 210*c*, 210*d*, 210*e***)=(0,0,1,0,0) is generated from the circuit board.

During the needle-changing process, when the desired needle, say the needle #4, reaches the working position, the sensing plate will block the light beam in the photo detector **210*d*, thereby causing the generation of a signal pattern (210*a*, 210*b*, 210*c*, 210*d*, 210*e*)=(0,0,0,1,0), which is termed the first positioning signal. This also actuates the driving of the small disk 211. When the desired needle #4 reaches the working position, the gap portion on the small disk 211 lies within the space in the photo detector 212, which is equivalent to the photo detector 112 of the first prior art, thereby allowing the light beam to pass through the gap portion on the small disk 211 and thus causing the generation of the second positioning signal. The action of the whole needle-changing process is based on these two positioning signals. It is a drawback of this prior art that its structure includes the gear set 27 and the small disk 211**, which significantly increase the cost in mechanical parts and assemblage. Moreover, the requirement of two positioning signals increases the complexity of the structure. It also lacks the capability to restore the position of the current working needle after a power failure which would cause the working needle to be out of position.

SUMMARY OF THE INVENTION

It is therefore a primary objective of the present invention to provide a needle-changing mechanism which uses only one positioning signal for the changing and positioning of needles of an embroidery sewing machine.

It is another objective of the present invention to provide a needle-changing mechanism which is capable of restoring the position of the current working needle after a power failure which would cause the working needle to be out of position.

It is still another objective of the present invention to provide a needle-changing mechanism which is constructed without the use of gears so as to reduce the cost and facilitate easy assemblage.

In accordance with the above and other objectives of the present invention, there is provided a needle-changing mechanism for use in a multiple-needle embroidery sewing machine for controlling the positioning of a selected sewing needle to a working position above a circular opening on the sewing platform of the sewing machine. The needle-changing mechanism includes a sensing plate having a gap portion, the sensing plate being operable by a spiral shaft driven by a motor. The position of the gap portion is changed by moving the sensing plate according to which needle is to be selected as the working needle. A plurality of photo detectors, equal in number to the number of the needles of the sewing machine, are arranged at equal intervals along a straight line relative to the sensing plate, such that the gap portion and the outside portions of the sensing plate cause the photo detectors to output a pattern of positioning signals. A controller, which receives and processes the output signals from the photo detectors, is used to control the movement of the needles so that the desired needle is positioned as the working needle.

BRIEF DESCRIPTION OF THE DRAWINGS

The present invention can be more fully understood by reading the subsequent detailed description of the preferred embodiments thereof with references made to the accompanying drawings, wherein:

FIGS. 5*a*–5*b* show the structure of a photo detector used in the needle-changing mechanism according to the present invention; wherein FIG. 5*a* shows a front view and FIG. 5*b* shows a side view;

DETAILED DESCRIPTION OF THE PREFERRED EMBODIMENTS

Figure 1:
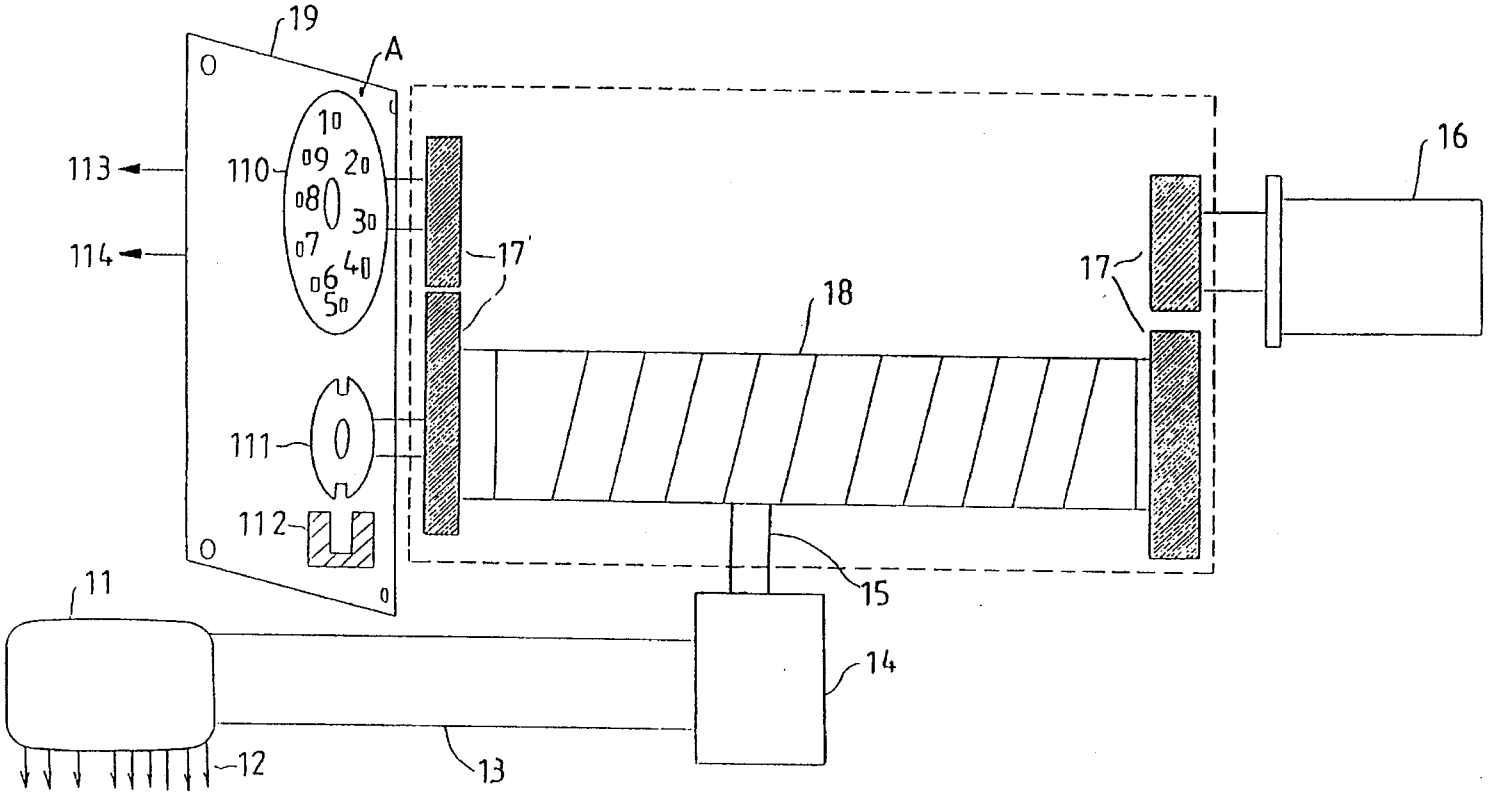
PRIOR ART FIG.1
FIG. 1 is a schematic diagram of a first prior art needle-changing mechanism used in an embroidery sewing machine.
Figure 2:
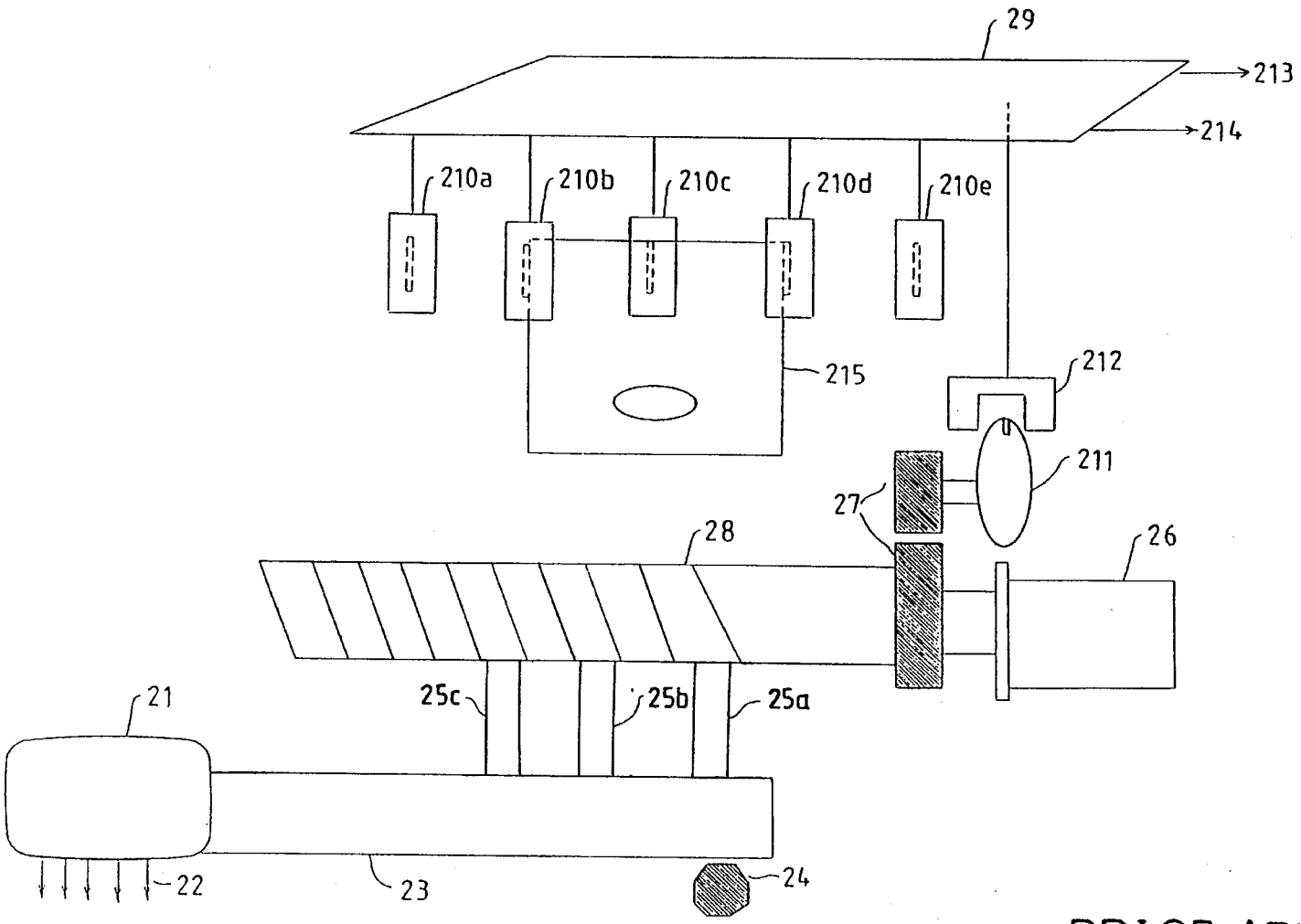
PRIOR ART FIG. 2
FIG. 2 is a schematic diagram of a second prior art needle changing mechanism used in an embroidery sewing machine.
Figure 3:
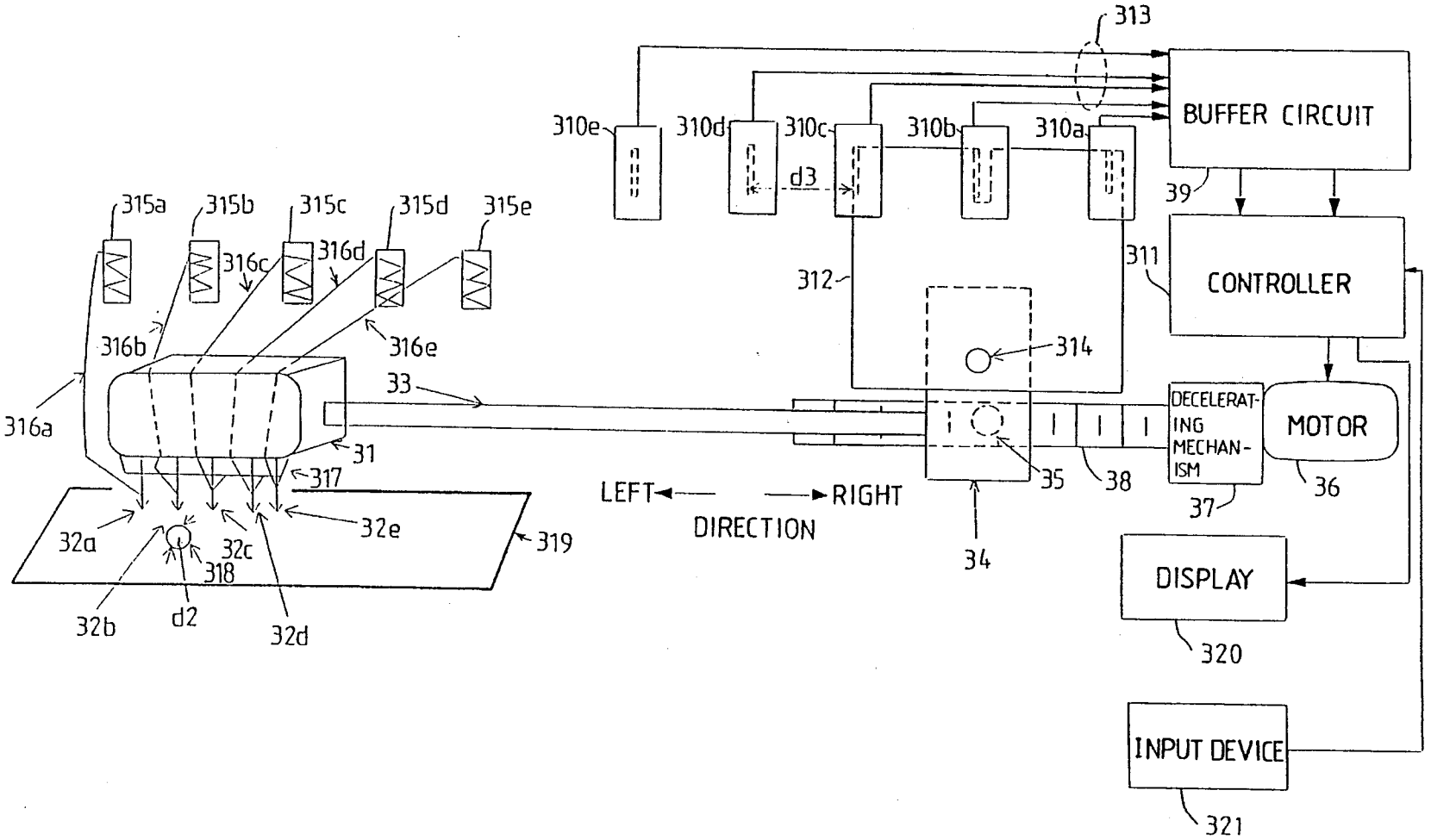
FIG. 3 is a schematic diagram of a needle-changing mechanism according to the present invention.

FIG. 3 shows a preferred embodiment of the present invention, which comprises a sewing head 31, a set of five needles 32*a*–32*e* fixed onto sewing head 31, a transmission bar 33, a sliding block 34, a sliding stud 35, a motor 36, a speed changing mechanism 37, a spiral shaft 38, a buffer circuit 39, an array of five photo detectors 310*a*–310*e*, a controller 311, a sensing plate 312, five signal lines 313 for transferring the output of the photo detectors 310*a*–310*e* to the buffer circuit 39, a screw 314 for joining sensing plate 312 to the sliding block 34, and a set of five bobbins 315*a*–315*e* for supplying threads 316*a*–316*e* to the sewing head 31, a spring 317, a circular opening 318, a sewing platform 319, a display 320, and an input device 321.

The needles 32*a*–32*e* are fixed to the sewing head 31. Threads 316*a*–316*e* from the bobbins 315*a*–315*e* pass through the eyelet of these needles 32*a*–32*e* and onwards to the spring 317 to be clamped there. The sliding stud 35 on the sliding block 34 is inserted in the groove of the spiral shaft 38. The sensing plate 312 is fixed by the screw 314 on the sliding block 34. The transmission bar 33 connects the sliding block 34 to the sewing head 31. The photo detectors 310*a*–310*e* are equally spaced along a straight line. When the spiral shaft is driven to rotate, the sensing plate 312 with the gap portion moves within the designed range in which the photo detectors 310*a*–310*e* are provided, and causes the photo detectors to send out a set of status signals via the buffer circuit 39 to the controller 311. The controller 311 can be PC-based or any other customized unit. The command to change colors in the embroidery, which is implemented by changing the current working needle to another, can be input through the input device 321 (such as a keyboard) to the PC-based controller 311. Based on the status signal 313 from the array of photo detectors and the input command, the controller 311 issues a motor driving signal to the motor 36. The spiral shaft 38 is then rotated, which in turn moves the sliding block 34 and the transmission bar 33, thereby moving the sewing head 31. In this way, the working needle is changed and the number indicating which needle is selected as the current working needle is shown on the display 320.

Figure 5B:
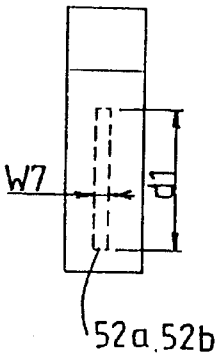
Figure 5A:
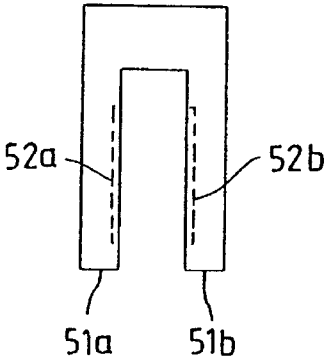
Figure 4:
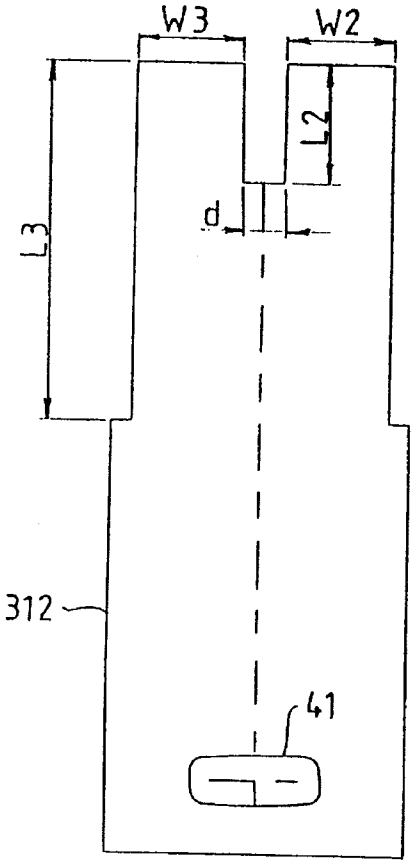
FIG. 4 shows the structure of a sensing plate used in the needle-changing mechanism according to the present invention.

FIG. 4 shows the structure of the sensing plate 312. In addition, FIG. 5*a* shows a front view and FIG. 5*b* shows a side view of each photo detector. A gap portion having a depth of L2 and a width of d is formed at one end of the sensing plate. The side to the right of the gap portion has a width of W2 and the side to the left has a width of W3. As shown in FIGS. 5A and 5B, each of the photo detectors 310*a*–310*e* has two opposite side walls 51*a*, 51*b* separated by a space S, and the side walls 51*a*, 51*b* having inner grooves 52*a*, 52*b* respectively. Each of the grooves 52*a* and 52*b* has a length of d1 and a width of W7. The circular opening 318 on the sewing platform 319 has a diameter of d2. The five photo detectors are equally spaced apart at a distance d3. To assure that positioning of the needle is correct, the following relationships must be satisfied:

$$W2=W3=d3$$

$$L3 \geqq L2 \geqq d1$$

$$d2 \geqq d \geqq W7$$

The numeral 41 in FIG. 4 designates a hole for the screw 314 (shown in FIG. 3) to bolt the sensing plate 312 to the sliding block 34 securely. In one groove 52*a* of the photo detector, there is provided a light-emitting diode 52*c*, and in another groove 52*b*, there is provided a light-detecting diode 52*d*. The light beam from the light-emitting diode 52*c* emits a light beam which passes through the spaces S to the light-detecting diode 52*d*. The sensing plate 312 is so disposed to travel through the spaces S of the five photo detectors 310*a*–310*e* which are arranged such that the centers of their spaces S are aligned in one straight line, and the gap portion of the sensing plate 312 can be more selectively coincide with one of the grooves of the five photo detectors. When the sensing plate 312 is moved to cause the gap portion D to coincide with the space S of one photo detectors, the light beam from the light emitting diode 52*c* is allowed to pass through the gap portion D so that the light can be received by the corresponding light detecting code 52*d*. In the meantime, the two edges of the sensing plate 312 block the light beams of two of the five photo detectors at the two sides of the sensing plate. When the light beam is blocked by the sensing plate 312, a digital signal "1" is generated; otherwise, a digital signal "0" is generated. For example, in FIG. 3 when the photo detectors 310*a* and 310*c* are blocked by the sensing plate 312 while the photo detectors 310*b*, 310*d*, and 310*e* are not a signal pattern (1,0,1,0,0) is generated.

Figure 6:
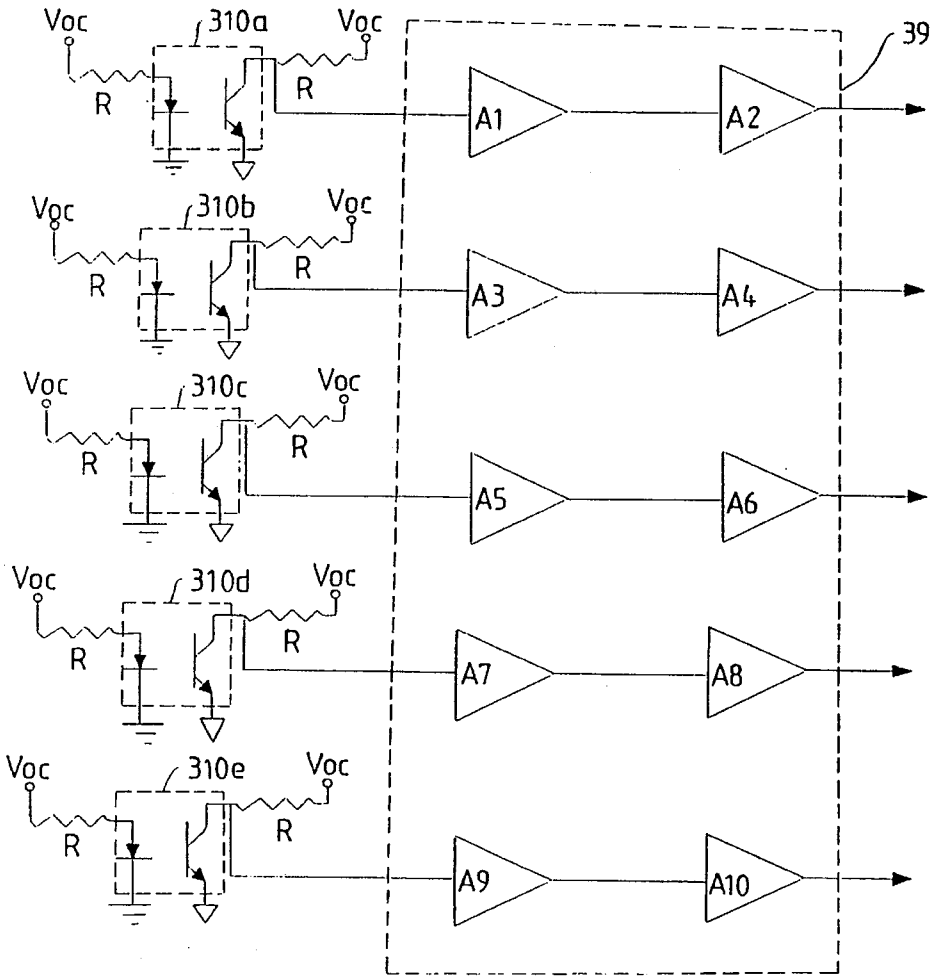
FIG. 6 shows the structure of a buffer circuit used in the needle-changing mechanism according to the present invention; and FIG. 7A

FIG. 6 shows the structure of the buffer circuit 39. For each of the photo detectors 310*a*–310*e*, the output signal is sent via a low-noise amplifier A1, A3, A5, A7, or A9 (such as a 74LS14) and a buffer amplifier A2, A4, A6, A8, or A10 (such as a 74LS04) to the controller 311.

Referring back to FIG. 3, the method for three-point positioning to achieve the purpose of color-changing in the embroidery will be explained below. As shown in the drawing, when the array of photo detectors 310*a*–310*e* send out a signal pattern, (310*a*, 310*b*, 310*c*, 310*d*, 310*e*)=(1,0,1,0,0), it is indicated that the current working needle is 32*b*. The rule is that, in the signal pattern, a "0" signal must exist between two "1" signals. Accordingly, in the signal pattern, (310*a*, 310*b*, 310*c*, 310*d*, 310*e*)=(1,0,1,0,0), the second signal "0" corresponds to the working needle. Accordingly, if the current working needle atop the circular opening 318 is 32*d*, then the photo detectors 310*a*–310*e* output a signal pattern, (310*a*, 310*b*, 310*c*, 310*d*, 310*e*)=(0,0,1,0,1). However, since the photo detectors are arranged along a straight line, the photo detectors at the two ends, namely 310*a* and 310*e*, must be otherwise judged. The following rule will be used: for a corresponding needle to be in working position, the signal from either end in the signal pattern must be "0" and its neighboring signal must be "1" and all the remaining signals are "0". Therefore, according to this rule, when the current working needle is 32*e*, then the photo detectors output signals "1" and "0", respectively, and thus the signal pattern is (310*a*, 310*b*, 310*c*, 310*d*, 310*e*)=(0,0,0,1,0). If the user wishes to apply another color to the embroidery, the needle number bearing the thread of the desired color can be input through the input device. In the example of FIG. 3, the current working needle is 32*b*, so the signal pattern is (310*a*, 310*b*, 310*c*, 310*d*, 310*e*)=(1,0,1,0,0). Therefore, when a command to change the working needle to 32*d* is issued by the controller 311, the motor 36 drives the sensing plate 312 and the sewing head 31 to move to the left. At the time the sensing plate 312 blocks the light beam in the photo detector 310*d*, the output signal of the detector 310*d* turns from "0" to "1". At the moment when the signal is about to turn from "1" back to "0", the controller 311 stops the motor and then checks the status of the photo detectors 310*a*–310*e*. If the signal pattern shows (310*a*, 310*b*, 310*c*, 310*d*, 310*e*)=(0,0,1,0,1), the positioning condition is satisfied; in other words, the needle 32*d* is positioned precisely on top of the circular opening 318 on the sewing platform 319. If the signal pattern is detected to be (310*a*, 310*b*, 310*c*, 310*d*, 310*e*)=(0,0,0,1,1), the positioning condition is not yet satisfied. In this case, the controller 311 commands the motor 36 to rotate backwards so as to move the sensing plate 312 and the sewing head 31 to the right. At the moment when the output signal of the photo detector 310*d* is about to turn from "1" to "0", the controller 311 stops the motor 36 and then checks the status of the photo detectors 310*a*–310*e*. The controller 311 repeats such a process to continuously displace the sewing head 31 until the positioning condition is satisfied.

As for the positioning of the two end-side needles 32*a* and 32*e*, suppose that the current working needle is 32*b* and it is desired to employ the needle 32*e* as the working needle in the next step. When such a command is obtained from the input device 321, the controller 311 drives the motor 36 to rotate in the positive direction, thereby causing the sensing plate 312 and the sewing head 31 to move to the left. When the sensing plate 312 blocks the light beam in the photo detector 310*e*, the output signal from there turns from "0" to "1". Meanwhile, the controller 311 prepares to stop the motor 36 when the output signal of the photo detector 310*e* turns from "1" back to "0". After that, the controller 311 checks if the signal pattern (310*a*, 310*b*, 310*c*, 310*d*, 310*e*) is (0,0,0,1,0). If yes, the needle 32*e* is in position. If not and the bit output of (310*d*, 310*e*) is (0,1), the controller 311 commands the motor to rotate in the negative direction, thereby causing the sensing plate 312 and the sewing head to move to the right. At this time, the controller 311 prepares to stop the motor 36 when it detects that the output signal of the photo detector 310*e* turns from "1" to "0". After that, the controller 311 checks whether the needle 32*e* is in position. If not, the process will be repeatedly carded out to move the sewing head 31 back and forth until the needle 32*e* is in position. From there, it can be learned why the condition $d \geqq W7$ is so set. If d (the width of the gap portion on the sensing plate) is smaller than W7, then during the needle-changing process, due to the inertia of the rotor of the motor and because the motor 36 is not provided with a braking mechanism, the motor 36 cannot be stopped when it undergoes back-and-forth rotation. Furthermore, the condition $d2 \geqq d$ is so set because this allows for accurate fine adjustments for positioning of the sensing plate relative to the photo detector.

As for the detection of the absolute positions of the needles after a power failure or interruption, if the working needle is not positioned right above the circular opening 318 on the sewing platform 319, the signal pattern from the array of photo detectors will contain two consecutive bits of "1", for example (310*a*, 310*b*, 310*c*, 310*d*, 310*e*) is (0,0,1,1,0). In this case, it is indicated that the gap portion of the sensing plate 312 lies between the photo detectors 310*c* and 310*d*. In other words, the needles 32*c* and 32*d* are positioned on either side above the circular opening 318. If the out-of-position working needle is beyond the two end needles 310*a* and 310*e*, the signal pattern from the array of photo detectors will be either (310*a*, 310*b*, 310*c*, 310*d*, 310*e*)=(1,0,0,0,0) or (310*a*, 310*b*, 310*c*, 310*d*, 310*e*)=(0,0,0,0,1). In the latter case, the output of the end photo detector 310*e* is "1" and those of all the remaining photo detectors are "0", indicating that the gap portion D of the sensing plate 312 is beyond the photo detector 310*e*. In other words, the needle 32*e* is at the left of the circular opening 318. Based on the foregoing, the controller 311 can set the working needle at the needle numbers 32*c* or 32*d* (for needles not at the end-sides) or at 32*e* (for needles at the end-sides), such that the working needle can be positioned quickly.

Figure 7A:
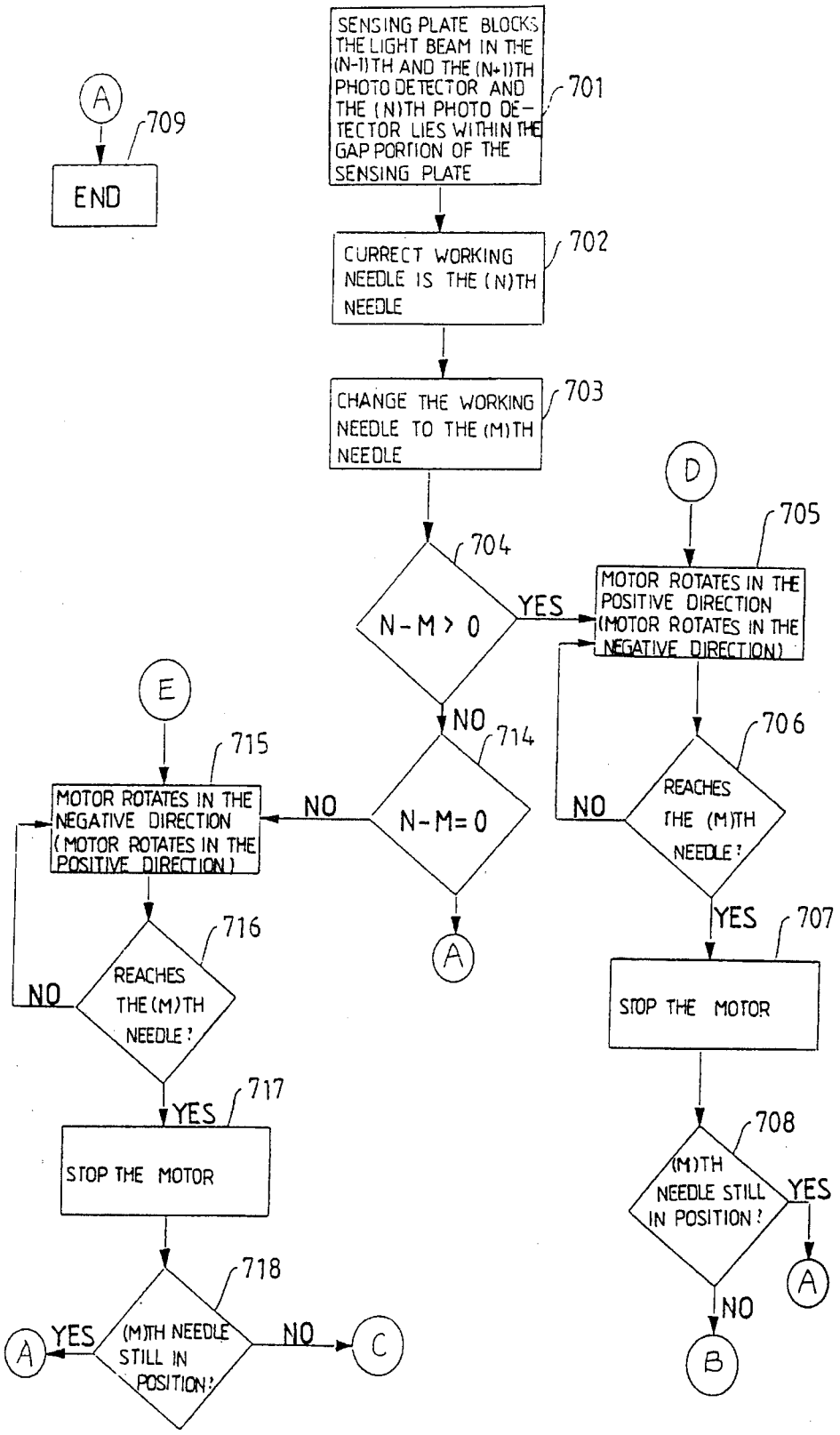
FIG. 7B is a flow diagram showing the procedure of the operation of the needle-changing mechanism according to the present invention.
Figure 7B:
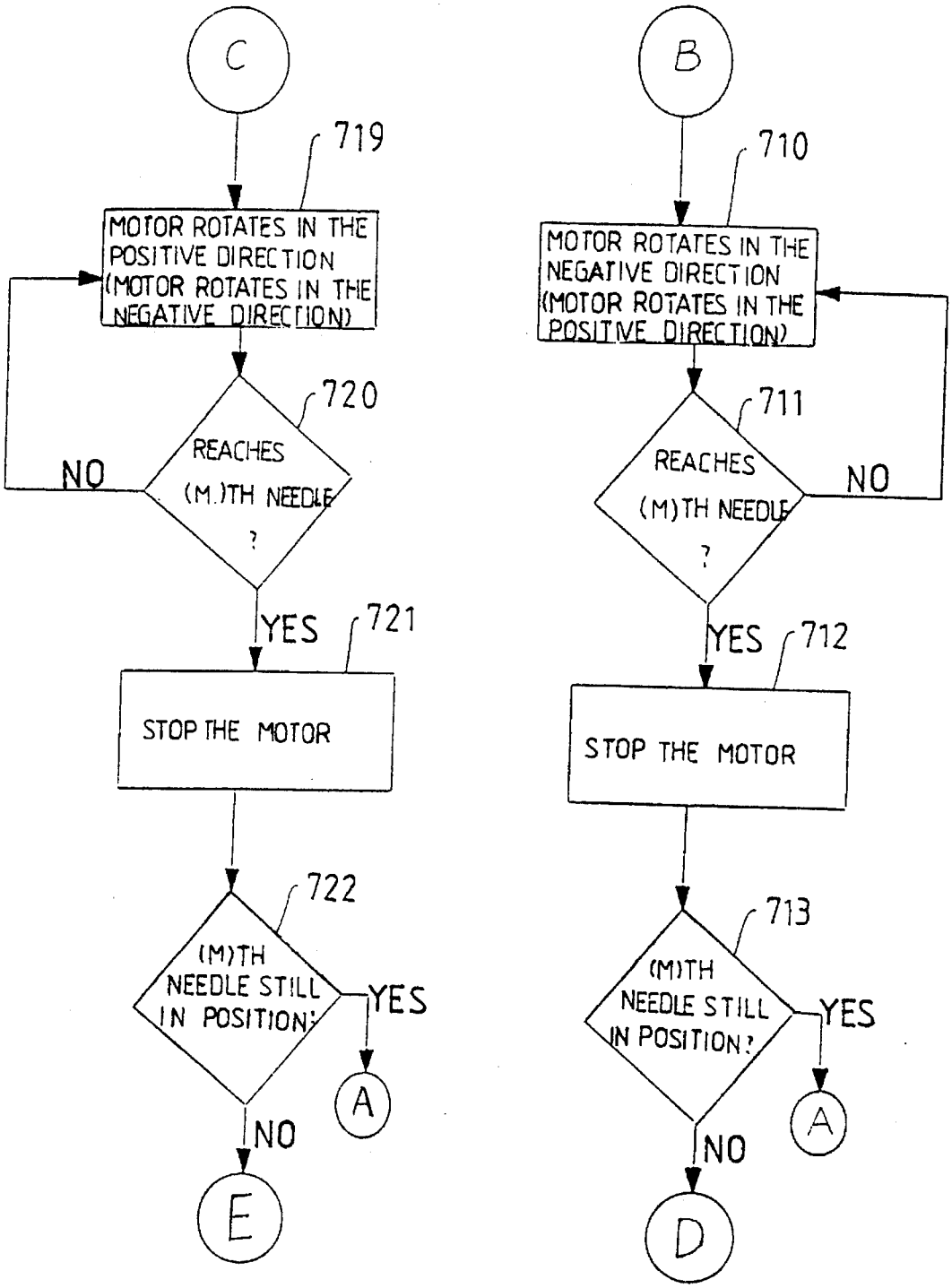

FIG. 7 shows the flow diagram for needle-changing and the positioning control of the present invention. In the flow diagram, n and m represent two integers. In Step 701, the sensing plate blocks the light beam in the (n−1)th and (n+1)th photo detector and the (n)th photo detector lies between the gap portion of the sensing plate. In Step 702, it is learned that the current working needle is the (n)th needle. In Step 703, a command from the input device wants to change the current working needle from the (n)th to the (m)th one. In Step 704, it is checked whether n>m. If YES, the procedure goes to Step 705, in which the motor is driven to rotate in the positive direction and whereby the spiral shaft is driven to move to the left. In Step 706, the three-point positioning method is used to determine whether the (m)th needle is in position as the working needle. If NOT, the procedure returns to Step 705, in which the motor is kept moving in the positive direction until the (m)th needle is in position. When the (m)th needle is in position, the procedure goes to Step 707, in which the motor is stopped. Subsequently, in Step 708, it is checked whether the (m)th needle is still in position. If YES, the (m)th needle is in position as the current working needle and the procedure goes to Step 709 and ends there. If NOT, it is indicated that the sewing head is overshot and the (m)th needle is not in position above the circular opening. In this case, the procedure goes to Step 710, in which the motor is driven to rotate in the negative direction and whereby the spiral shaft is caused to move to the right. Subsequently, in Step 711 it is detected whether or not the (m)th needle is in position. If NOT, the procedure returns to Step 710, in which the motor is kept moving in the negative direction until the (m)th needle is in position. When the (m)th needle is in position, the procedure goes to Step 712, in which the motor is stopped. Next, in Step 713, it is detected whether or not the (m)th needle is still in position. If YES, it is assured that the (m)th needle is in position as the working needle. The procedure thus goes to Step 709 and ends there. If NOT, it is indicated that the sewing head is overshot and the procedure returns to Step 705, in which the motor is driven to rotate reversely in the positive direction. After repeated adjustment, the (m)th needle can be shifted in position. If in Step 704, it is detected that $n \leqq m$, the procedure goes to Step 714 to detect whether $n=m$. If YES, it is indicated that a needle-changing process is not necessary and the procedure goes to Step 709 and ends there. On the contrary, if $n \neq m$, it is certain that $n<m$. The procedure thus goes to Step 715, in which the motor is driven to rotate in the negative direction and whereby the spiral shaft is moved to the right. Next, in step 716, it is detected whether the (m)th needle is in position. If NOT, the procedure returns to Step 715, in which the motor is kept moving in the negative direction until the (m)th needle is in position. If YES, the procedure goes to Step 717, in which the motor is stopped. Subsequently, in Step 718, it is detected whether or not the (m)th needle is still in position. If YES, it is assured that the (m)th needle is in position and the procedure goes to Step 709 and ends there. If NOT, it is indicated that the sewing head is overshot. The procedure thus goes to Step 719, in which the motor is driven to rotate reversely in the positive direction and whereby the spiral shaft is moved to the left to adjust the position of the (m)th needle. Next, in Step 720 it is detected whether the (m)th needle is in position. If NOT, the procedure goes back to Step 719, in which the motor is kept moving in the positive direction until the (m)th needle is in position. If YES, the procedure goes to Step 721, in which the motor is stopped. Next, in Step 722, it is detected whether the (m)th needle is still in position. If YES, it is assured that the (m)th needle is in position. If NOT, it is indicated that the sewing is overshot. The procedure thus goes back to Step 715, in which the motor is driven to rotate reversely in the negative direction for fine adjustment of the position of the (m)th needle. When the (m)th needle is in position, the procedure goes to Step 709 and ends there.

With the structure described above, the needle-changing mechanism of the present invention can be constructed with less cost since such costly and complex mechanical parts as gears are eliminated. It is also easier to assemble. After a power failure or interruption, the position of the working needle can be restored so that the sewing machine can be back into operation quickly. The sewing mechanism of the present invention can be applied in multiple-needle embroidery sewing machines, including the horizontal type and the rotatory type.

The present invention has been described hitherto with an exemplary preferred embodiment. However, it is to be understood that the scope of the present invention need not be limited to the disclosed preferred embodiment. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A needle-changing mechanism for use in a multiple-needle embroidery sewing machine having a plurality of sewing needles and a sewing platform with an opening thereon, said needle-changing mechanism being provided for controllably changing the position of a selected working sewing needle to a working position above the circular opening on the sewing platform of the sewing machine, said needle-changing mechanism comprising:

(a) a movable sensing plate having two solid side portions and a gap portion between said two solid side portions, said sensing plate being constructed such that the position of said gap portion is changed by moving said sensing plate according to which needle is selected as the working needle;

(b) a plurality of photo detectors, said photo detectors are arranged at equal intervals along a straight line relative to said sensing plate, each of said photo detectors has two opposing side walls generally parallel to said sensing plate defining a gap which allows said sensing plate to travel therethrough, said two opposing side walls are provided with two opposing grooves, respectively, and said two opposing grooves are provided with a light emitting diode and a light detecting diode, respectively such that said gap portion and said two solid side portions of said sensing plate will cause said photo detectors to output a pattern of positioning signals; and (c) a controller, which is provided with means for receiving and processing said output positioning signals from said photo detectors, for controlling the movement of said needles so that the selected working needle is positioned as the working needle.

2. A needle-changing mechanism for use in multiple-needle embroidery sewing machines as claimed in claim 1, wherein said sensing plate is constructed according to the following specifications:

$$W2=W3=d3;\ L2 \geqq d1;\ \text{and}\ d2 \geqq d \geqq W7;$$

wherein:

W2 is the width of a solid side portion to a first side of said gap portion;

L2 is the length of said gap portion;

W3 is the width of a solid side portion to a second side of said gap portion;

d is the width of said gap portion;

d1 is the length of said groove provided on said side wall of each photo detector;

d2 is the diameter of said circular opening on the sewing platform of the sewing machine; and d3 is the distance between two adjacent photo detectors.

3. A needle-changing mechanism for use in multiple-needle embroidery sewing machines as claimed in claim 1 which further comprising a display means for displaying which needle is currently selected as the working needle.

4. A needle-changing mechanism for use in multiple-needle embroidery sewing machines as claimed in claim 1, wherein the number of said photo detectors is equal to or greater than 3.

5. A needle-changing mechanism for use in multiple-needle embroidery sewing machines as claimed in claim 1, wherein each of said photo detectors is structured to send a first binary signal when said gap portion of said sensing plate is aligned between its light emitting diode and light detecting diode so as to allow light emitted from said light emitting diode to be received by said light detecting diode, and a second binary signal when said light is blocked by said solid side portions.

6. A multiple-needle embroidery sewing machine with a needle-changing mechanism, comprising a plurality of sewing needles, a sewing platform with an opening formed thereon, and a needle-changing mechanism for controllably moving the position of a selected working sewing needle to a working position above the opening on the sewing platform, wherein said needle-changing mechanism comprises:

(a) a movable sensing plate having two solid side portions and a gap portion between said two solid side portions, said sensing plate being constructed such that the position of said gap portion is changed by moving said sensing plate according to which needle is being selected as the working needle;

(b) a plurality of photo detectors, which are equal in number to the number of said plurality of needles of the sewing machine, said photo detectors are arranged at equal intervals along a straight line relative to said sensing plate, each of said photo detectors has two opposing side walls generally parallel to said sensing plate defining a gap which allows said sensing plate to travel therethrough, said two opposing side walls are provided with two opposing grooves, respectively, and said two opposing grooves are provided with a light emitting diode and a light detecting diode, respectively such that said gap portion and said two solid side portions of said sensing plate will cause said photo detectors to output a pattern of positioning signals; and (c) a controller, which is provided with means for receiving and processing said output positioning signals from said photo detectors, and means for controlling the movement of said needles so that the selected working needle is positioned as the working needle.

7. A multiple-needle embroidery sewing machine with a needle-changing mechanism as claimed in claim 6, wherein said sensing plate is constructed according to the following specifications:

$W2=W3=d3$; $L2 \geqq d1$; and $d2 \geqq d \geqq W7$;

wherein:

W2 is the width of a solid side portion to a first side of said gap portion;

L2 is the length of said gap portion;

W3 is the width of a solid side portion to a second side of said gap portion;

d is the width of said gap portion;

d1 is the length of said groove provided on said side wall of each photo detector;

d2 is the diameter of said circular opening on the sewing platform of the sewing machine; and d3 is the distance between two adjacent photo detectors.

8. A multiple-needle embroidery sewing machine with a needle-changing mechanism as claimed in claim 6, which further comprises a display means for displaying which needle is currently selected as the working needle.

9. A multiple-needle embroidery sewing machine with a needle-changing mechanism as claimed in claim 6, wherein the number of said photo detectors is equal to or greater than 3.

10. A multiple-needle embroidery sewing machine with a needle-changing mechanism as claimed in claim 6, wherein each of said photo detectors is structured to send a first binary signal when said gap portion of said sensing plate is aligned between its light emitting diode and light detecting diode so as to allow light emitted from said light emitting diode to be received by said light detecting diode, and a second binary signal when said light is blocked by said solid side portions.

11. A multiple-needle embroidery sewing machine with a needle-changing mechanism as claimed in claim 6, wherein said multiple-needle embroidery sewing machine is selected from the group consisting of single-head rotary type and multiple-head type multiple-needle embroidery sewing machine.

* * * * *